US005103725A

United States Patent [19]

Sugimoto et al.

[11] Patent Number: 5,103,725

[45] Date of Patent: Apr. 14, 1992

[54] PRINTER WITH SHEET FEEDING APPARATUS

[75] Inventors: Kazuaki Sugimoto; Tomio Nishijima, both of Numazu; Teruhisa Inoue, Tagata; Yoshihiko Sugimoto, Susono; Masashi Suzuki, Sunto; Izumi Matsushita, Tagata, all of Japan

[73] Assignee: Tokyo Electric Company, Ltd., Tokyo, Japan

[21] Appl. No.: 724,718

[22] Filed: Jul. 2, 1991

Related U.S. Application Data

[62] Division of Ser. No. 628,432, Dec. 17, 1990, Pat. No. 5,056,432, which is a division of Ser. No. 469,021, Jan. 23, 1990, Pat. No. 5,007,340.

[30] Foreign Application Priority Data

| | | | |
|---|---|---|---|
| Jan. 24, 1989 | [JP] | Japan | 1-14796 |
| Jan. 25, 1989 | [JP] | Japan | 1-15651 |
| Jan. 26, 1989 | [JP] | Japan | 1-16676 |
| Jan. 27, 1989 | [JP] | Japan | 1-18574 |
| Jan. 27, 1989 | [JP] | Japan | 1-18575 |

[51] Int. Cl.[5] ..... B41F 13/56

[52] U.S. Cl. ..... 101/227; 400/621; 271/306; 271/184; 271/213; 101/242

[58] Field of Search ..... 101/224, 226, 227, 237, 101/238, 239, 240; 400/621; 271/306, 184, 202, 207, 209, 213; 355/310

[56] References Cited

U.S. PATENT DOCUMENTS

| | | | |
|---|---|---|---|
| 2,782,712 | 2/1957 | Claff et al. | 101/227 |
| 3,670,645 | 6/1972 | Hill | 101/227 |
| 3,942,786 | 3/1976 | Lauren | 271/177 |
| 3,945,633 | 3/1976 | Knopp | 271/202 |
| 3,994,221 | 11/1976 | Littleton | 101/227 |
| 3,994,487 | 11/1976 | Wichlund | 271/184 |
| 4,034,845 | 7/1977 | Honegger | 271/207 |
| 4,200,016 | 4/1980 | Helmig et al. | 271/202 |
| 4,280,406 | 7/1981 | Corse | 101/227 |
| 4,453,466 | 6/1984 | Shinmoto | 101/240 |
| 4,463,940 | 8/1984 | Mock | 271/184 |
| 4,526,464 | 7/1985 | Milillo . | |
| 4,590,859 | 5/1986 | Fou et al. | 101/227 |
| 4,593,893 | 6/1986 | Suter | 101/226 |
| 4,756,245 | 7/1988 | Roch | 101/227 |
| 4,867,435 | 9/1989 | Cogswell et al. | 271/202 |
| 4,948,714 | 8/1990 | Bowman et al. | 271/202 |

FOREIGN PATENT DOCUMENTS

| | | | |
|---|---|---|---|
| 0225412 | 7/1985 | Fed. Rep. of Germany | 271/207 |
| 56-121784 | 9/1981 | Japan . | |
| 63-67235 | 3/1988 | Japan . | |

*Primary Examiner*—Eugene H. Eickholt

*Attorney, Agent, or Firm*—Oblon, Spivak, McClelland, Maier & Neustadt

[57] ABSTRACT

Disclosed herein is a printer with a sheet feeding apparatus having a printer body incorporating a printing mechanism for printing onto continuous forms. A cutter is provided close to a continuous forms discharging port on the printer case. Following the cutter downstream, there is provided a sheet feeding belt that rotates at a rate higher than the feed rate of the continuous forms. Along the belt, there are provided a sheet traversing section, a sheet direction changing section, a sheet pushing section and a sheet stacker, in that order from upstream to downstream. The sheet traversing section seizes and feeds horizontally each sheet cut by the cutter. The sheet direction changing section perpendicularly changes the feed direction of each cut sheet. The sheet pushing section pushes each sheet onto the sheet stacker where an orderly stack of sheets is formed.

3 Claims, 18 Drawing Sheets

PRINTER WITH SHEET FEEDING APPARATUS

This is a division of application Ser. No. 07/628,432, filed on Dec. 17, 1990 and now U.S. Pat. No. 5,056,432 which in turn is a division of application Ser. No. 07/469,021 filed on Jan. 23, 1990, now U.S. Pat. No.5,007,340.

FIELD OF THE INVENTION AND RELATED ART STATEMENT

The present invention relates to a printer with a sheet feeding apparatus whereby necessary text is printed on continuous forms, the forms being cut to suitable size to produce sheets of paper such as labels, the sheets of paper thus produced being consecutively fed away from the printer to a sheet stacker for orderly stacking.

There have been prior art printers having a cutter cut printed continuous forms to suitable size in order to produce sheets of paper such as labels. These printers are designed so that the feed rate of continuous forms inside the printer case containing the printing mechanism is lower than the feed rate of cut sheets coming out of the cutter. The purpose of this arrangement is to stack a large number of cut sheets neatly in the order in which they were cut. This prevents the cut sheets from getting stacked in a confused, irregular manner.

The prior art stacking method involves having cut sheets fed consecutively onto an inclined slide, over which the sheets slide down onto a suitable sheet stacker in stack.

With the above conventional method, placing cut sheets onto a slide to have them slide down thereon often disorients the sheets in transit, causes the sheets to be stacked on the sheet stacker in a disorderly manner, or otherwise disturbs the sheet stacking operation.

In addition, letting the cut sheets drop by gravity and stack onto the sheet stacker may put one sheet after another in correct order but often results in a more or less disorderly state of stacking. This requires careful—and troublesome—handling of the stacked sheets so as not to crumple or otherwise damage them upon removal from the sheet stacker.

OBJECT AND SUMMARY OF THE INVENTION

It is therefore an object of the present invention to provide a printer with a sheet feeding apparatus whereby the sheets cut from continuous forms are reliably forwarded and stacked on a sheet stacker in the exact order in which they were printed and cut.

It is another object of the present invention to provide a printer with a sheet feeding apparatus whereby different sizes of sheets cut from continuous forms are reliably stacked onto a single sheet stacker.

It is a further object of the present invention to provide a printer with a sheet feeding apparatus whereby different sizes of sheets cut from continuous forms are stacked onto a sheet stacker in the exact order in which they were cut.

It is yet another object of the present invention to provide a printer with a sheet feeding apparatus whereby sheets of paper cut from continuous forms on a roll, naturally curled in one direction because of their stored condition, are effectively rid of their curls and come out as straightened flat sheets.

It is another object of the present invention to provide a printer with a sheet feeding apparatus whereby any sheet cut from continuous forms, if jammed in transit, is readily detected without the need to make attendant adjustments.

According to one aspect of the present invention, there is provided a printer case that incorporates a printing mechanism for printing on continuous forms. A cutter is installed close to a continuous forms discharge port on the printer case. Adjacent to the cutter, there is provided a sheet feeding belt that rotates at a feed rate higher than that for the continuous forms. Over this belt and away from the cutter, there are provided a sheet traversing section, a sheet direction changing section and a sheet pushing section, in that order. The sheet traversing section takes sheet after sheet of paper cut from continuous forms by the cutter, and transports the sheets horizontally while keeping it level. The sheet direction changing section changes the cut sheets perpendicularly in the feed direction. The sheet pushing section pushes the cut sheets consecutively onto a sheet stacker attached. Sheets of paper in transit are kept from overlapping with one another because the feed rate of cut sheets coming out of the cutter is higher than the feed rate of the continuous forms. A flat contact surface of the sheet traversing section immediately downstream of the cutter ensures positive feed of cut sheets. Following the sheet traversing section are the sheet direction changing section and the sheet pushing section. Both sections are designed to make sure that sheets of paper are placed perpendicularly onto the sheet stacker, and that one sheet after another is added reliably, orderly and consecutively behind the last sheet stacked thereon.

According to another aspect of the present invention, there is provided a printer case that incorporates a printing mechanism for printing on continuous forms. Close to a continuous forms discharge port of the printer case, there is provided a sheet feeding apparatus comprising a cutter and a sheet pushing section adjacent thereto. To the sheet feeding apparatus, there are fixed a first and a second strut. The first strut has latching edges positioned perpendicularly. The second strut has perpendicular relief notches and sliding ledges that are located on both sides and positioned perpendicularly. There is also provided a horizontally long sheet stacker that holds each of the stacks sheets of paper in a substantially perpendicular manner. A sheet pushing member installed so as to slide freely along the sheet stacker receives the tips of the sheets. The sheet stacker is further equipped with relocatable rollers contacting the sliding edges as well as projections that are positioned lower than the rollers and are inserted into the relief notches to contact the latching edges.

This arrangement works as follows: The continuous forms, after being printed with necessary text by the printing mechanism inside the printer case, are cut by the cutter into sheets of paper. The cut sheets are forwarded consecutively by the sheet pushing section onto the sheet stacker and stack there in the traversing direction, each sheet being positioned perpendicularly. The sheet stacker, when its free edge side is raised by hand, disengages its projections from the latching edges. This allows the stacker to move up and down. When the hand is removed from the moving sheet stacker, its projections are again engaged with the latching edges, thereby securing the stacker in that position. This means that cut sheets of different sizes may be accommodated by the same sheet stacker.

According to a further aspect of the present invention, there is provided a continuous forms feeding path equipped with a printing mechanism and a cutter adjacent thereto. Past the cutter, sheets of paper are transported downward by an endless feeding belt having a pushing member that holds each sheet in transit. Adjacent to the end of the feeding belt, there is provided a stacking member comprising a substantially horizontal sheet receiving surface with which the lower ends of the sheets come in contact. The stacking member is moved freely up and down by a stacking section supporting means. Above the sheet receiving surface, there is provided a sheet supporting member comprising a substantially vertical sheet supporting surface that keeps the sheets upright. Two guide rods are provided to support slidingly the sheet supporting member on both its sides in the stacking direction. The guide rods are positioned at substantially the same height as the end of the feeding belt.

As described above, this arrangement comprises the endless feeding belt that has its pushing member hold sheets of paper for downward transport; the stacking member located adjacent to the end of the feeding belt and having the substantially horizontal paper receiving surface contacting the lower ends of the sheets; the sheet supporting member located above the sheet receiving surface and having the substantially vertical sheet supporting surface that keeps the sheets upright; and the two guide rods located on both sides of the sheet supporting member and slidingly movable in the stacking direction. Thus there develops a degree of resistance at the movable sheet supporting member due to friction with the guide rods. The sheet supporting member is pushed by sheets of paper coming consecutively from the printer. The sheets are stacked one by one against the stacking member. In addition, the pressure from the sheets of paper being pushed in by the feeding belt is applied to the positions where the sheet supporting member is supported. The reason for this is that there is provided the stacking member supporting means movably supporting the stacking member in the vertical direction and that guide rods slidingly supporting the sheet supporting member are at substantially the same height as the end of the feeding belt. Therefore the sheet supporting member does not develop an enough degree of moment to cause the sheets to fall; the sheets remain upright.

According to yet another aspect of the present invention, there is provided a printer case that incorporates a printing mechanism for printing on continuous forms. A cutter is installed close to a continuous forms discharge port of the printer case. Sheets of paper that are cut by the cutter are stacked onto a sheet stacker in the horizontal direction, each sheet being positioned in a substantially vertical manner. Between the sheet stacker and the cutter, there is provided a sheet feeding path having a straightening roller. This roller is pressed against the passing sheets to straighten them out after they have been cut and fed out of the continuous forms roll.

Located in the sheet feeding path adjacent to the cutter, the straightening roller straightens the curled cut sheets coming out of their rolled condition. The resulting output is a series of straightened, flat sheets that are placed onto the sheet stacker reliably and regularly.

According to another aspect of the present invention, there is provided a printer body which incorporates a printing mechanism and which has a cutter located adjacent thereto. The cutter is used to cut continuous forms to suitable size. Downstream of the cutter, there is provided a sheet feeding path followed by a sheet stacker. The sheet feeding path forwards cut sheets at a feed rate higher than that of the printing mechanism. The sheet stacker allows the sheets to be stacked thereon. The sheet feeding path has a sensor that senses the presence of each sheet. There are also provided a sheet length setting means, a time limiting means and a judging means. The sheet length setting means sets a length of sheets to be cut. The time limiting means sets allowable detection times for the sheet portion and for the sheet-to-sheet interval based on the sheet length established by the sheet length setting means. The judging means compares the output of the time limiting means with the output of the sensor, and accordingly generates a signal identifying normal feed or jammed feed.

The sensor detects the presence or absence of sheets and the length of the sheet-to-sheet interval, making it possible to see if any sheet is being jammed. Where the sheet size is altered, a signal from the sheet length setting means causes the time limiting means to set allowable detection times for each sheet and sheet-to-sheet interval on the sensor. This makes it possible to readily detect jammed sheets without the need to perform attendant adjustments in accordance with varying sheet sizes.

DETAILED DESCRIPTION OF PREFERRED EMBODIMENTS

Figure 1:
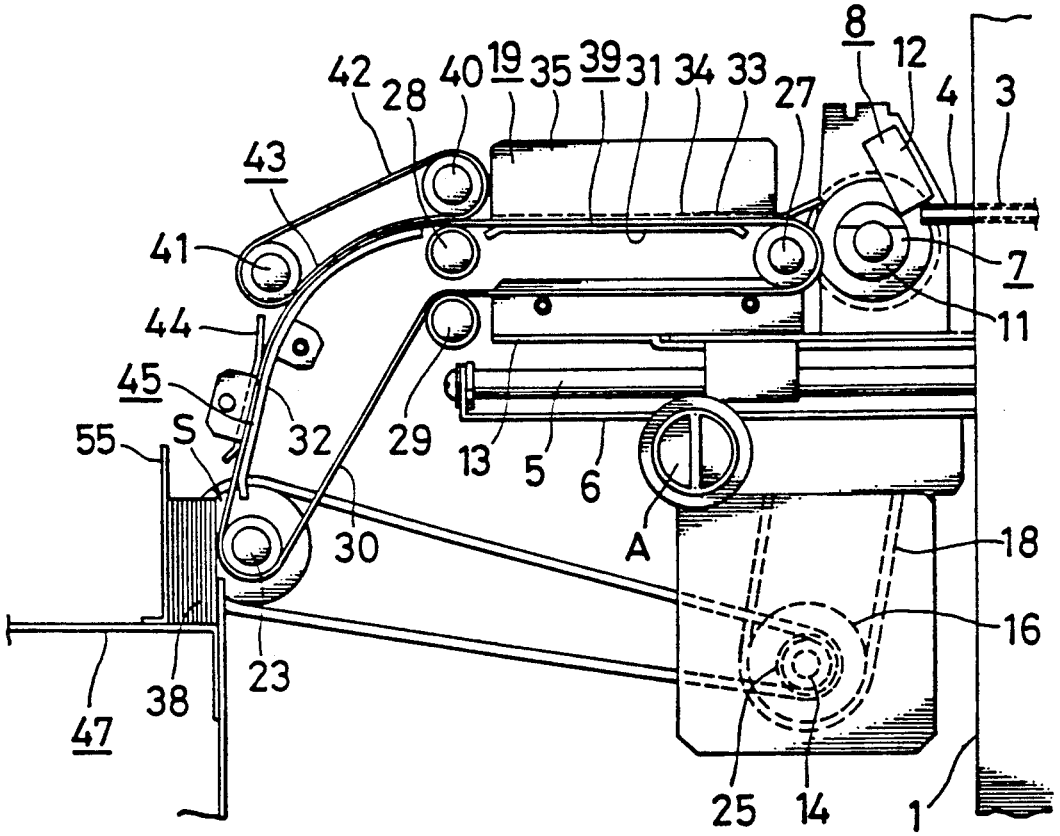
FIG. 1 is a side view of a sheet feeding apparatus, the base thereof not shown, which is a first embodiment of the present invention.
Figure 2:
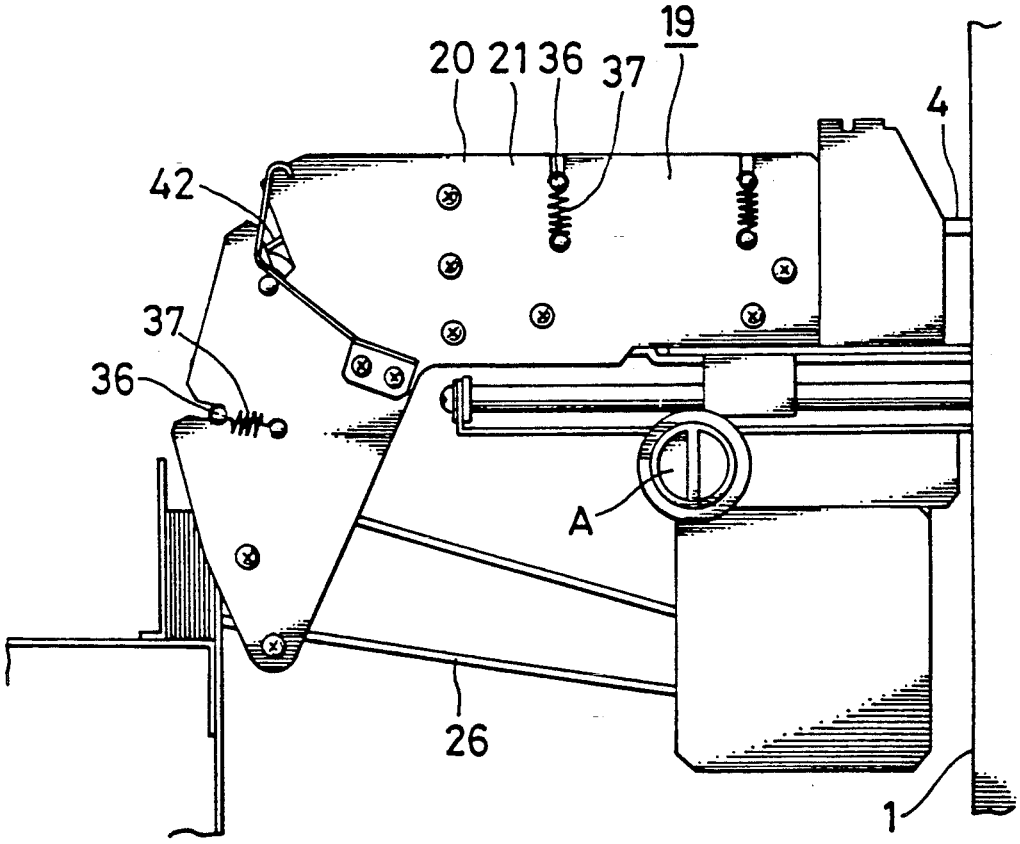
FIG. 2 is a side view of the sheet feeding apparatus as the first embodiment, with its base shown.
Figure 3:
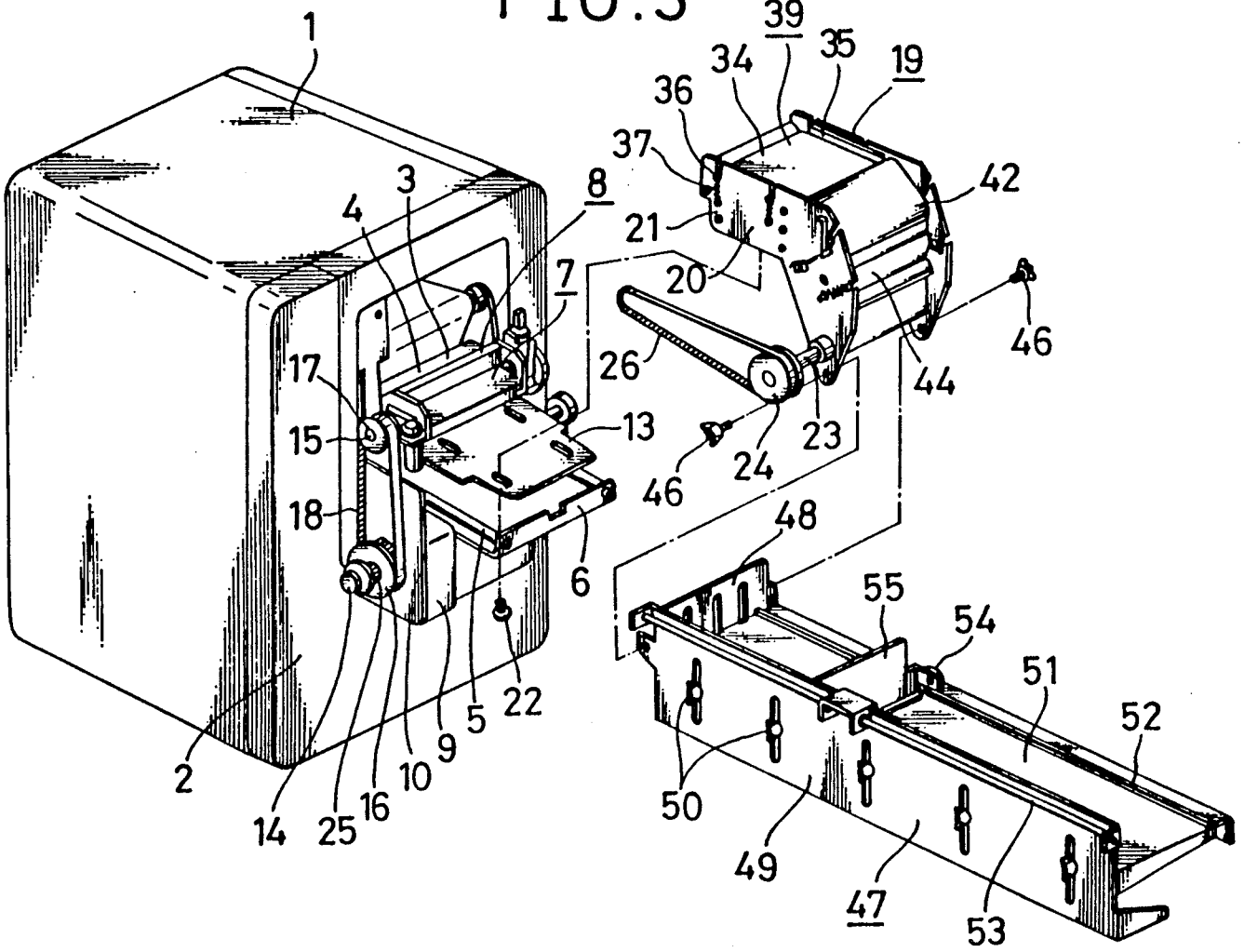
FIG. 3 is an exploded perspective view of the whole assembly of the first embodiment.
Figure 4:
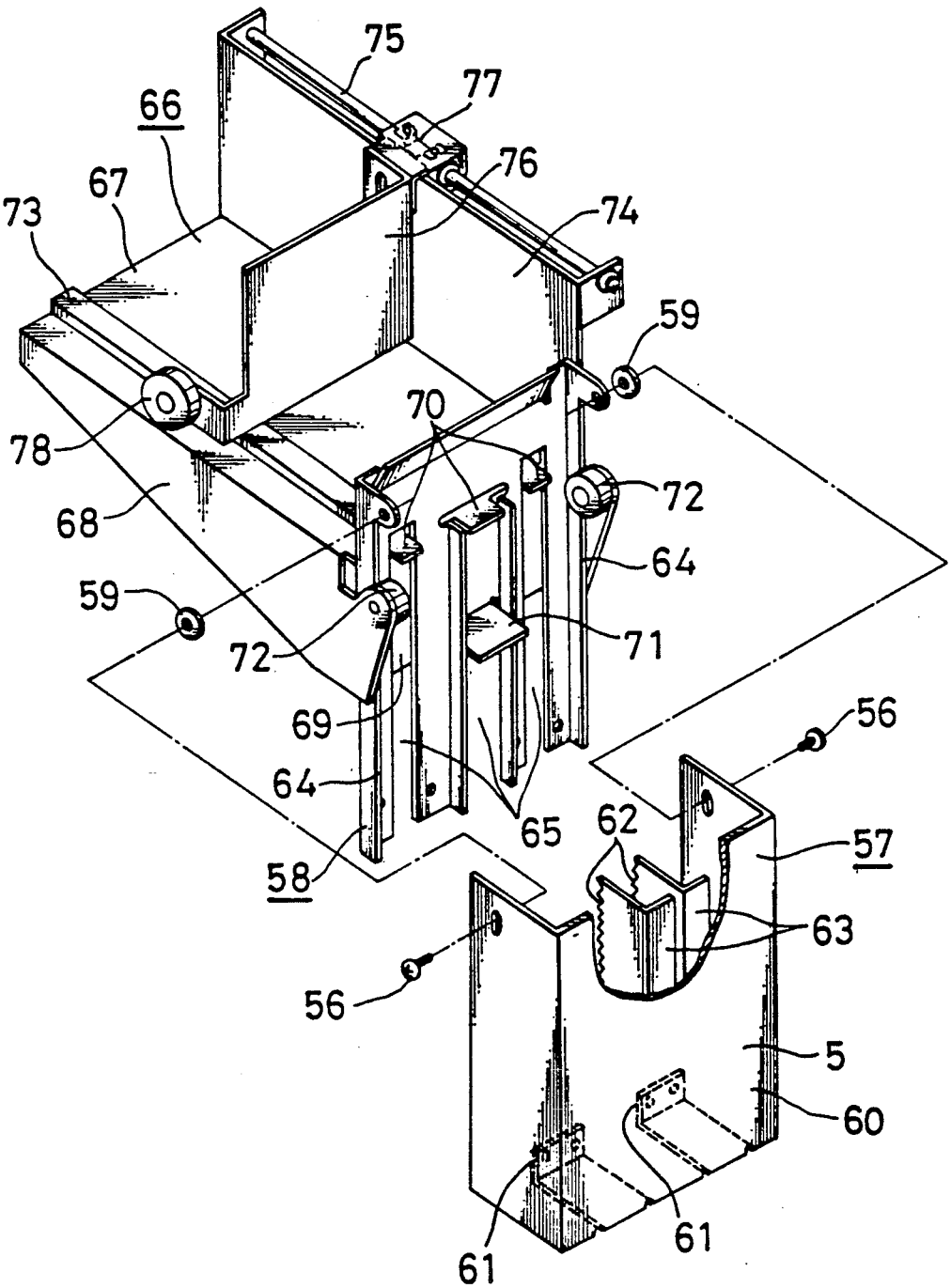
FIG. 4 is an exploded perspective view of a second embodiment of the present invention.
Figure 5:
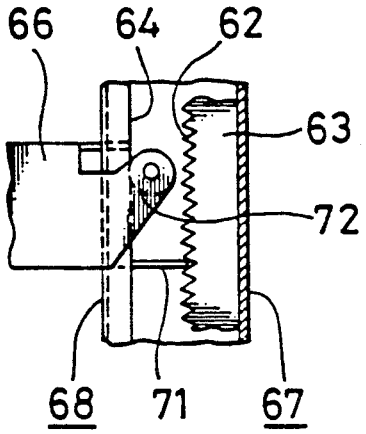
FIG. 5 is a side view of part of the second embodiment.
Figure 6:
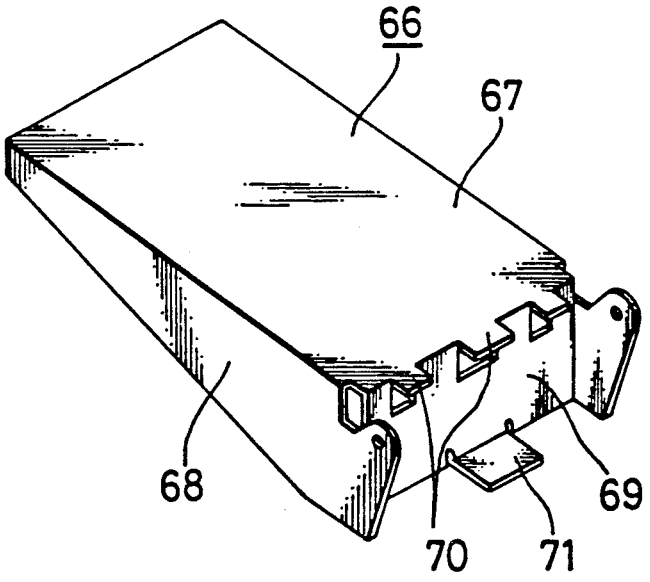
FIG. 6 is a perspective view of a sheet stacker according to the invention.
Figure 7:
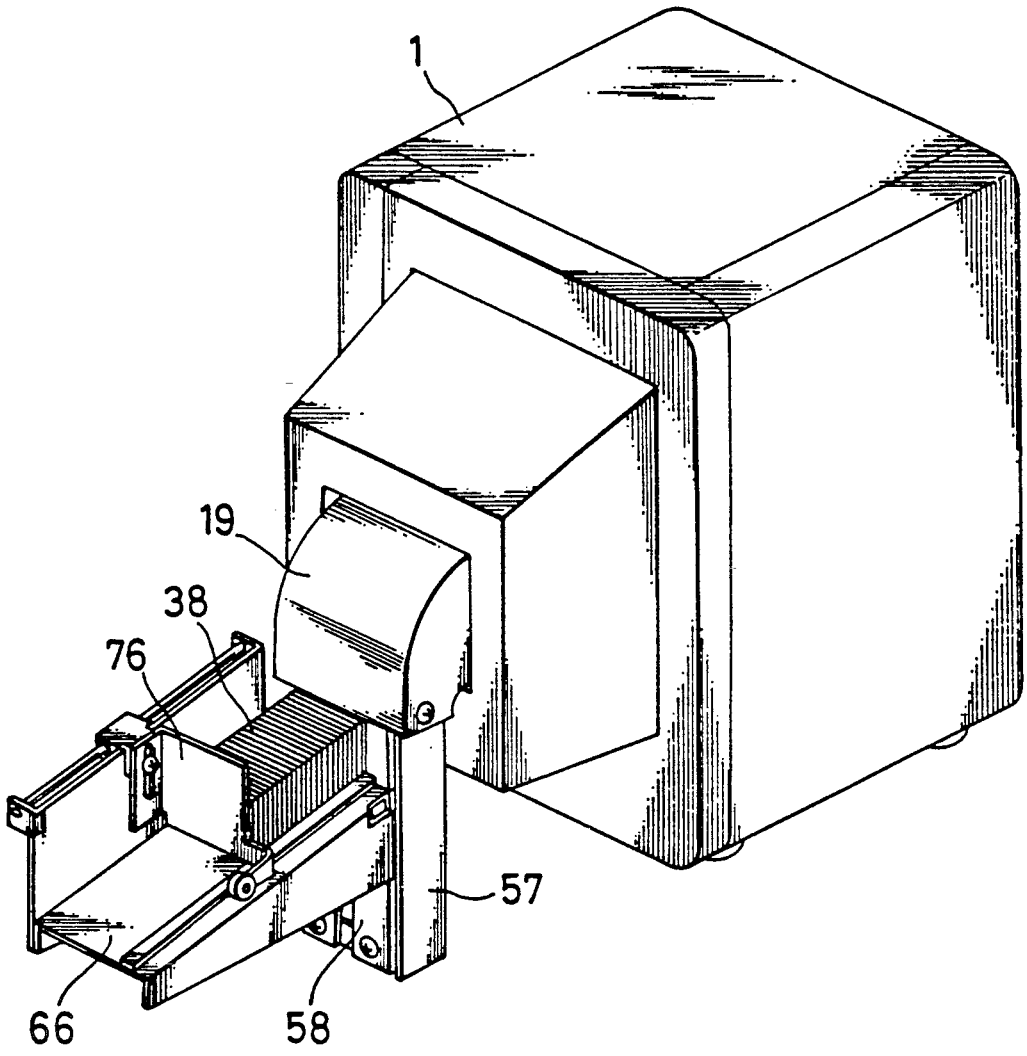
FIG. 7 is a perspective view of the whole assembly of the second embodiment.
Figure 8:
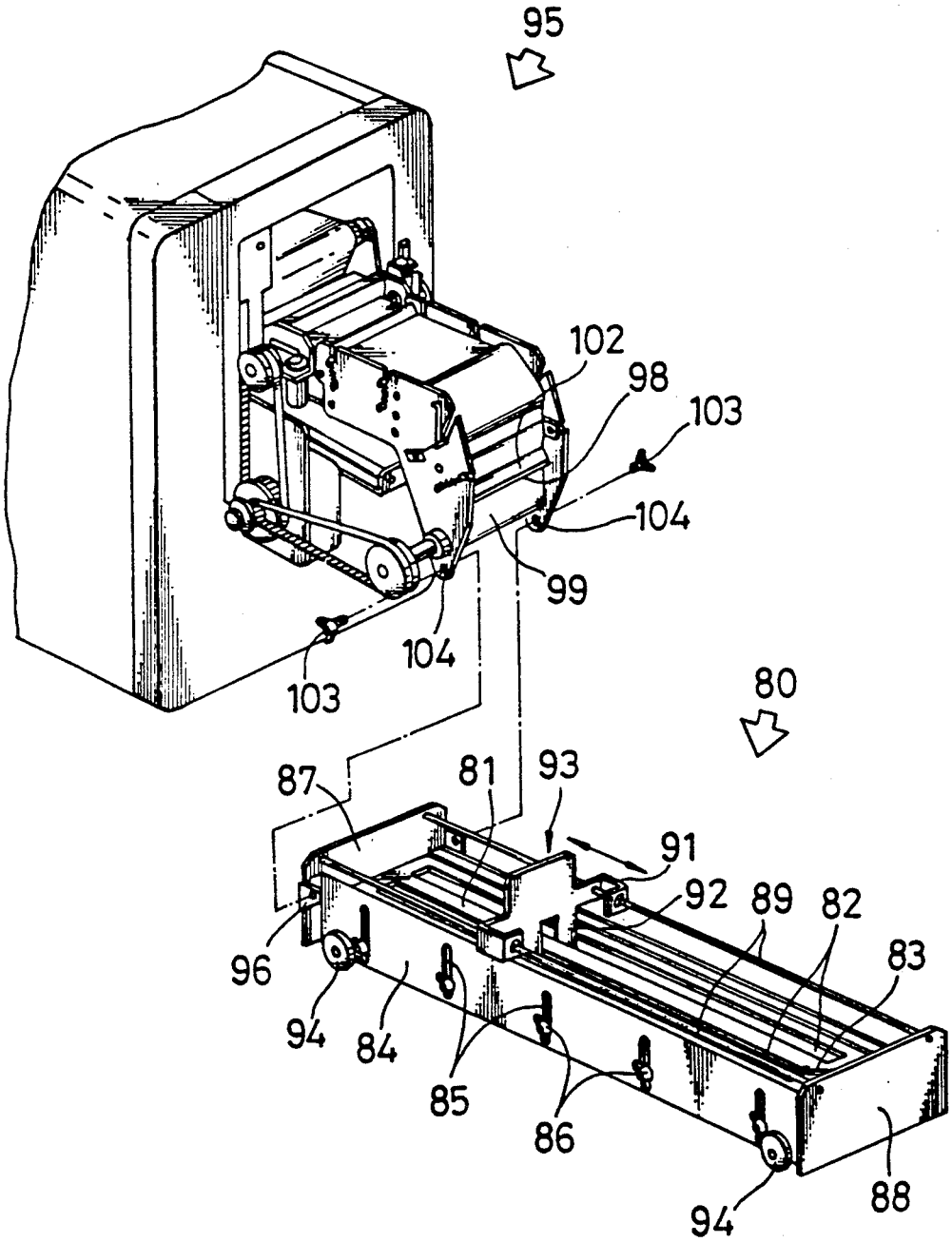
FIG. 8 is an exploded perspective view of a third embodiment of the present invention.
Figure 9A:
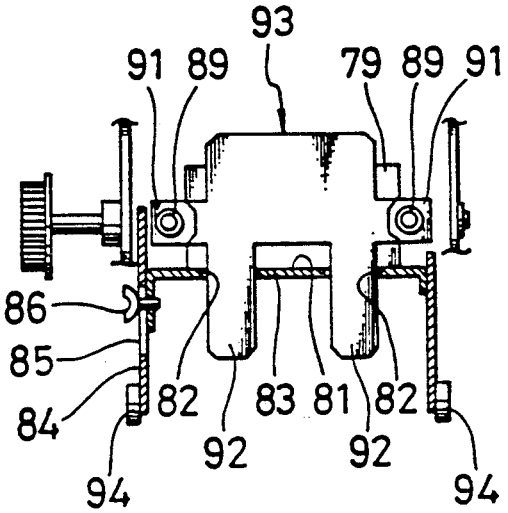
FIGS. 9(*a*), 9(*b*), 10(*a*) and 10(*b*) are views for helping to describe how cut sheets are stacked on the sheet stacker.
Figure 9B:
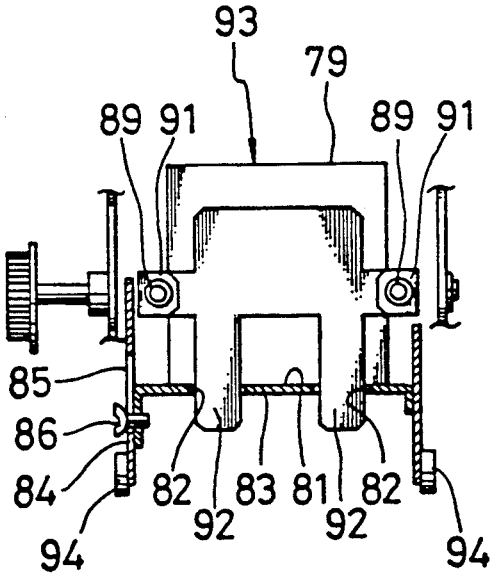

A first embodiment of the present invention will now be described by referring to FIGS. 1 through 3. A printer case 1 for the printer is of a rectangular prism shape. The printer case 1 contains a continuous forms holder and a printing mechanism for printing onto the forms, neither shown. One side 2 of the printer cased 1 comprises a continuous forms discharge port 4 with a label guide 3 projecting therefrom.

A fixture 6 with two rod-type parallel rails 5 projects from the side 2 of the printer case 1. To the fixture 6 is attached a cutter device 8 having a cutter 7. The cutter device 8 freely moves along the rails 5 and is fixedly positioned thereon where desired. An operation knob A is attached to the fixture 6. A pinion, now shown, is fixed to the shaft to which the operation knob A is attached. The pinion is engaged with a rack, not shown, which is provided on the cutter device 8. Turning the operation knob A causes the cutter device 8 to slide along the rails 5 of the fixture 6. The cutter device 8 has a frame 10 to which a motor 9 is attached. To the frame 10, there are attached a rotary blade 11 and a stationary blade 12 forming the cutter 7, as well as a sheet feeding apparatus support 13.

Pulleys 16 and 17 are fixed respectively to a motor shaft 14 of the motor 9 and to a shaft 15 of the rotary blade 11. A timing belt 18 is wound around, and held taut between, the pulleys 16 and 17. Between the shaft 15 of the rotary blade 11 and the pulley 17, there is provided a clutch that is engaged and disengaged by a solenoid, not shown. This keeps the rotary blade 11 from rotating during continuous operation of the motor 9 unless and until the clutch is engaged.

A sheet feeding apparatus 19 is mounted on the sheet feeding apparatus support 13. The sheet feeding apparatus 19 has a base 21 with opposing side plates 20. Four setscrews 22 attach the base 21 to the sheet feeding apparatus support 13. Below the base 21 is an idle shaft 23. A timing belt 26 is wound around, and held taut between, a pulley 24 fixed to the idle shaft 23 and a belt winding member 25 integrally attached to the pulley 16. Close to the cutter 7 on the base 21, a driven shaft 27 is installed. Two intermediate shafts 28 and 29 are provided between the driven shaft 27 and the idle shaft 23. An endless belt 30 of a constant width is wound around the idle shaft 23, driven shaft 27 and intermediate shafts 28 and 29. The belt 30 moves at a rate higher than the feed rate of the continuous forms in the printer case 1. Below the belt 30 between the driven shaft 27 and the intermediate shaft 28, there is provided a flat belt guide plate 31 being positioned horizontally. Inside the belt 30 between the intermediate shaft 28 and the idle shaft 23, there is provided a curved belt guide plate 32 which, with its end facing downward, is smoothly curved in the perpendicular direction.

Above the belt 30 on the belt guide plate 31, there is provided a flat pressure plate 34 having a flat contact surface 33. Two support pins 36 are provided on each of Vertical walls 35 on both sides of the pressure plate 34. The pressure plate 34 is pushed downward by a spring 37 engaged with the support pins 36. This constitutes a sheet traversing section 39 that keeps a sheet of paper 38, cut by the cutter 7, flat and in place under a constant level of pressure.

Two belt rollers 40 and 41 are located, one immediately above the intermediate shaft 28 and the other a little in back thereof. A pressure belt 42 is wound around the belt rollers 40 and 41. Between the rollers 40 and 41, the lower portion of the pressure belt 42 is pressed against and along the curved surface of the curved belt guide plate 32. The curved belt guide plate 32, the pressure belt 42 and the belt 30 together constitute a sheet direction changing section 43 that changes the feeding direction of the cut sheets 38.

A pressure plate 44 is installed opposite to the belt 30 behind the rear end of the curved belt guide plate 32. The pressure plate 44, the curved belt guide plate 32 and the belt 30 together make up a sheet pushing section 45. As with the pressure plate 34, the pressure plate 44 has a support pin 36 installed on its side. Outside the side plate 20, the spring 37 is attached to the support pin 36 so as to push the belt 30.

On both sides below the base 21 of the sheet feeding apparatus 19, the tips on both sides of a sheet stacker 47 are removably mounted by thumbscrews 46. The sheet stacker 47 has a front support plate 48 and a fixed side plate 49 positioned perpendicularly thereto. A base 51 is attached by thumbscrews 50 in a vertically movable manner to the front support plate 48 and fixed support side plate 49. A guide rail 52 is mounted along one side of the base 51 in the lengthwise direction. On the upper edge of the fixed side plate 49, there is provided a rod-shaped guide shaft 53 with both its ends secured. A sheet holding plate 55 is slidingly engaged with and freely moves along the guide shaft 53. The plate 55 has a roller 54 that travels outside the guide rail 52. The sheet holding plate 55 is under a constant degree of pressure from a plate spring, not shown, pressed against the outer periphery of the guide shaft 53.

In the above-described construction, the printing mechanism in the printer case 1 prints necessary text onto the continuous forms. After printing, the motor 9 is started when the tip of the continuous forms comes out of the label guide 3. The rotary blade 11 of the motor-driven cutter 7 rotates against the fixed blade 12, cutting a sheet of paper to a predetermined size off the continuous forms. At this point, the tip of the cut sheet 38 is already seized by the sheet traversing section 39 with its pressure plate 34. For this reason, immediately after being cut, the sheet is forwarded fast by the belt 30 that runs at a rate higher than the feed rate of the continuous forms. Thus there develops a certain distance between each cut sheet and the following tip of the continuous forms.

The sheet 38 that was cut in this manner is secured between the pressure belt 42 and the belt 30. Arriving at the sheet direction changing section, the sheet 38 is changed a little downward in its feeding direction.

With its direction thus changed, the sheet 38 is inserted vertically and consecutively between two opposing surfaces: the support plate 48 and the sheet holding plate 55 on the sheet stacker 47. That is, the sheet 38 having arrived last is positioned vertically against the outer surface of the belt 30 at the position where the idle shaft 23 is located. The belt 30 feeding sheets 38 is inclined downward past the intermediate shafts 28 and 29. This arrangement causes a V-shaped space S to develop above the sheet 38 that has arrived last onto the sheet stacker 47, thereby permitting a reliable pushing operation on the sheet 38. A sufficient level of pushing pressure against the sheet 38 is made available by a frictional force derived from the contact between the pressure plate 44 and the belt 30 supported by the curved belt guide plate 32. The sheet 38 stops when its lower tip comes in contact with the base 51 of the stacker 47. Thus another cut sheet is added to an orderly stack of sheets on the stacker 47.

A second embodiment of the present invention will now be described by referring to FIGS. 4 through 7. Like reference characters denote like or corresponding parts throughout the first and the second embodiment, and repetitive portions of the description thereof are omitted.

A first strut 57 and a second strut 58 are fixed by setscrews 56 to the lower end of the side plates 20 of the base 21 for the sheet feeding apparatus 19. Washers 59 are provided between the first strut 57 and the second strut 58.

The first strut 57 comprises a fastening base 60 that has a cross section of a rectangle with one of its sides missing when viewed from above. The lower end of the fastening base 60 has two, L-shaped fastening pieces 61 that are bent backward. Inside the fastening base 60, there are fixed two parallel latching members 63 that have vertical latching edges 62 comprising fine teeth. In front of the second strut 58, there are provided vertical sliding edges 64 that project forward, along with three relief notches 65. The lower end of the second strut 58 is connected to the fastening pieces 61 and thus integrally fixed to the first strut 57.

Between first strut 57 and the second strut 58, there is provided a sheet stacker 66 that is a section for accommodating cut sheets that arrive therein. The sheet stacker 66 comprises a flat, receiving surface 67, side plates 68 bent downward on both sides under the receiving surface 67, and a front plate 69 bent downward at the front. At the front end of the side plates 68, there are integrally provided three guide projections 70 engaged with the relief notches 65 of the second strut 58, along with a projection 71 engaged with the relief notches 65 in the middle. At the front end of the side plates 68 of the sheet stacker 66, there are rotatably mounted relocatable rollers 72 being in contact with the sliding edges 64. The relocatable rollers 72 and the projection 71 are positioned to one another so that the rollers 72 always remain above the projection 71. On one side of the receiving surface 67 of the sheet stacker 66, there is provided a guide rail 73 linearly positioned from front to rear.

A side plate 74 is fixedly mounted on one side of the sheet stacker 66. The side plate 74 is positioned perpendicular to the receiving surface 67 and stands upright. On the upper edge of the side plate 74, there is provided a rod-type guide bar 75 positioned fixedly and horizontally. To the guide bar 75, there is relocatably attached, through a joint, a sheet pushing member 76 which receives the flat surface of the stacked sheets 38 and which faces the front of the second strut 58. Between the joint of the sheet pushing member 76 and the guide bar 75, there is installed a plate spring 77. The plate spring 77 is slidingly pressed against the surface of the guide bar 75 so as to provide the sheet pushing member with a braking force. At the other end of the sheet pushing member 76, there is provided a relocatable roller 78 which is positioned outside the guide rail 73 and which moves along the receiving surface 67.

In the above-described construction, a sheet 38 is cut by the cutter 7 to a predetermined size from the continuous forms in the same manner as in the first embodiment. The sheet 38 is forwarded toward the sheet stacker 66.

One cut sheet 38 after another is vertically inserted into a clearance between the front of the second strut 58 and the sheet pushing member 76 on the receiving surface 67 of the sheet stacker 66. The consecutively inserted sheets form an orderly stack. That is, the sheet 37 having arrived last is vertically positioned by the outer surface of the belt 30 at the position where the idle shaft 23 is located, as in the first embodiment. The sheets 38 come in contact with the receiving surface 67 of the sheet stacker 66, forming a regular stack therein.

The rear end of the sheet stacker 66, being free, is secured where the projection 71 is manually engaged with the latching edges 62 of the first strut 57, with the relocatable rollers 72 being in contact with the sliding edges 64 of the second strut.

This arrangement makes the following possible: When the size of the sheet 38 is varied, the rear end of the sheet stacker 66 is moved up by hand to release the latching pressure between the projection 71 and the latching edges 62 as well as the pressurized contact between the relocatable rollers 72 and the sliding edges 64. In this state, the sheet stacker 66 may be moved up and down. The height of the sheet stacker 66 is determined in accordance with the new size of the sheet 38. Where the free end of the stacker is released at a suitable height, the projection 71 is again engaged with the latching edges 62 of the first strut 57. The relocatable rollers 72 again come in contact with the sliding edges 64 of the second strut 58. This firmly secures the sheet stacker 66 at the desired height.

The second embodiment has been described on the assumption that the latching edges 62 are formed so as to have a teeth-like latching means. In practice, a sufficient level of frictional force may be alternatively obtained by use of a hard rubber element instead of a tooth structure on the latching edges 62 positioned against the projection 71.

A third embodiment of the present invention will now be described by referring to FIGS. 8 through 11. On a sheet stacker 80, there is provided a flat-shaped stacking member 83 having two sliding grooves 82 on a substantially flat, sheet receiving surface 81. The stacking member 83 is supported in a vertically movable manner by thumbscrews 86 that penetrate vertically long grooves 85 on a side plate 84. Between a front connecting plate 87 and a rear plate 88 located fore and aft of the side plate 84, there are provided two parallel guide rods 89 on both sides. Facing the front connecting plate 87 and the rear plate 88, there are provided sheet support surfaces 90 substantially perpendicular to the stack member 83. On both sides of the sheet support surfaces 90, there are provided supports 91 each in a rectangular shape with one of its sides missing. Also provided is a sheet support member 93 having two downward projections 92 to be movably inserted into the sliding guide rails 82. The sheet support member 93 is slidingly supported on the sheet receiving surface 81 by the two guide rods 89 penetrating the supports 91. The supports 91 are each equipped with a plate spring and the attachments thereto, now shown, in contact with the guide rods 89. The sheet support member 93 slidingly moves along the guide rods 89 against a certain degree of frictional resistance. Rollers 94 are attached to the four corners of the sheet stacker 80 to provide the stacker with free mobility. The connecting plate 87 comprises connecting members 96 to be coupled with a printer 95.

Figure 11:
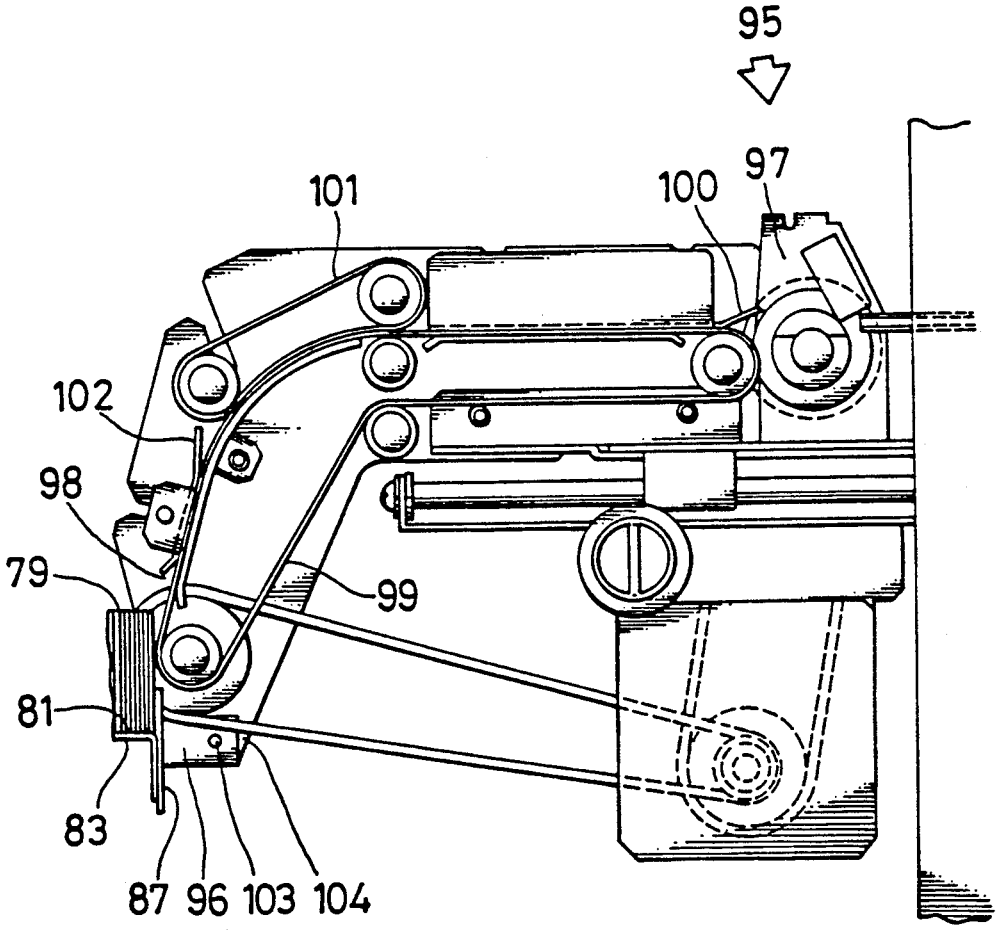
FIG. 11 is a vertical longitudinal sectional view of the sheet stacker.
Figure 12:
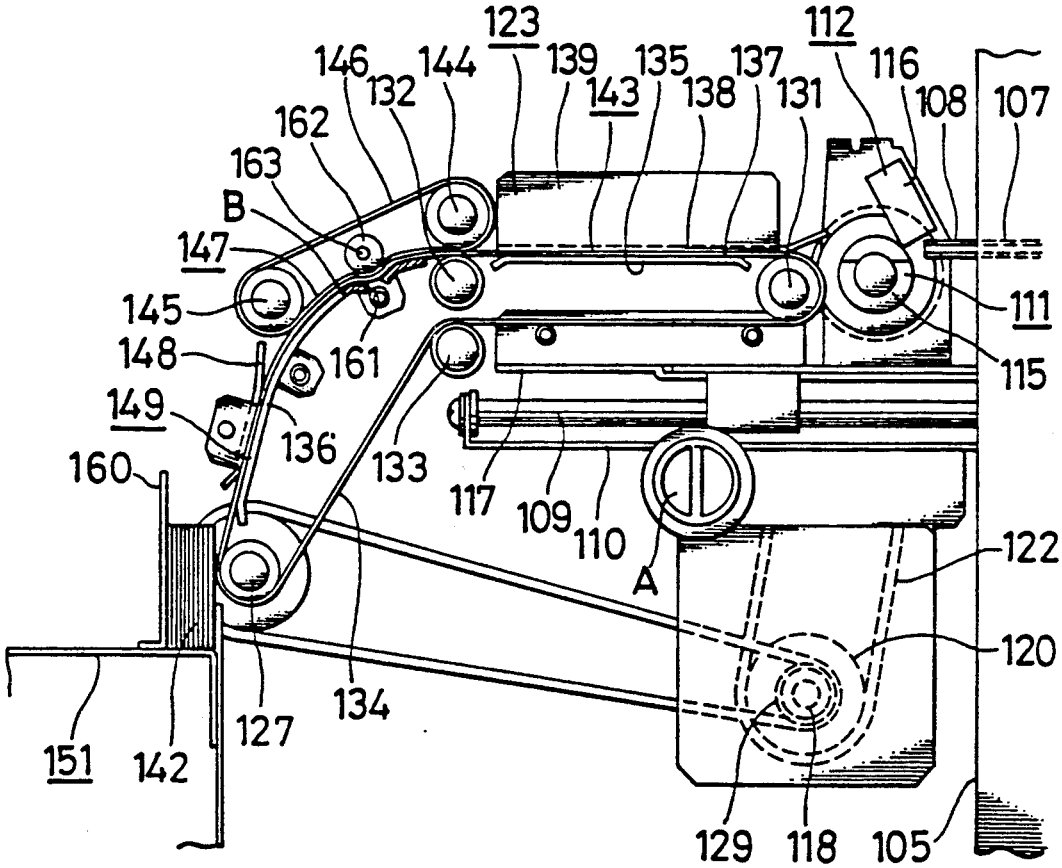
FIG. 12 is a side view of a sheet feeding apparatus, the base thereof not shown, which is a fourth embodiment of the present invention.
Figure 13:
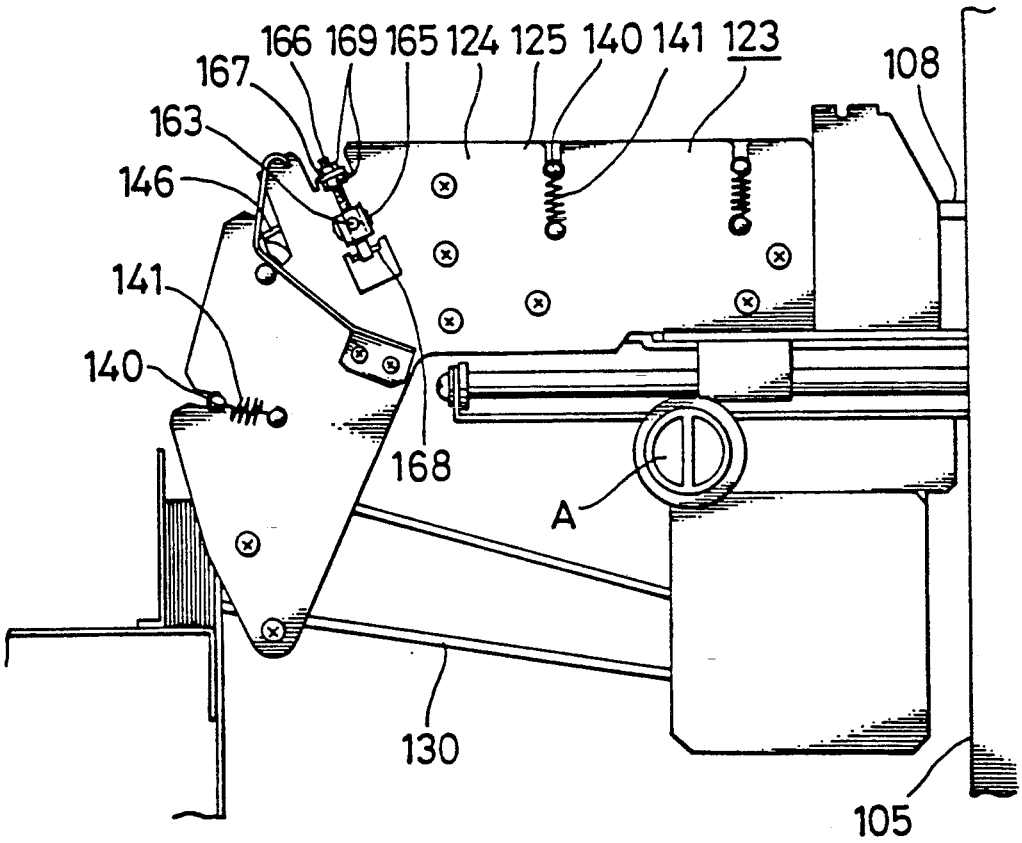
FIG. 13 is a side view of the sheet feeding apparatus as the fourth embodiment, with its base shown.
Figure 14:
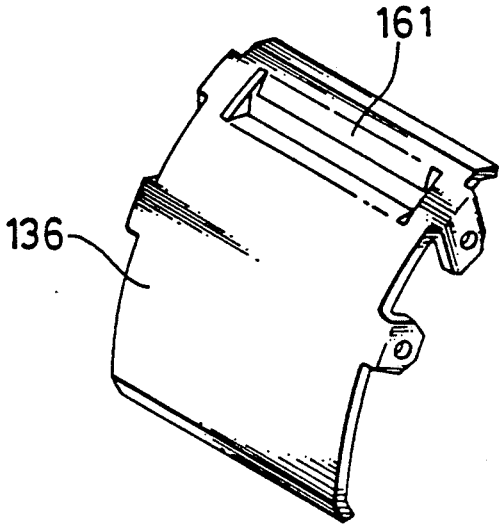
FIG. 14 is a perspective view of a curved belt guide plate according to the present invention.
Figure 15:
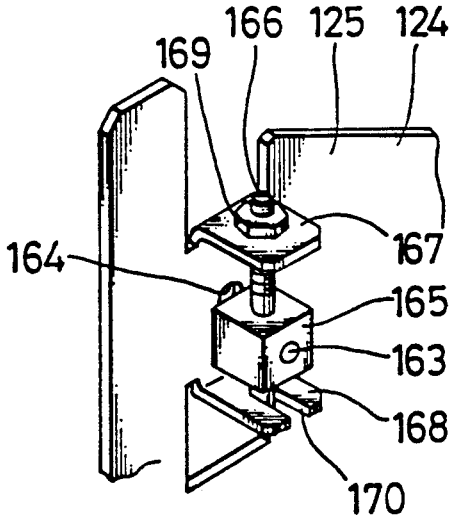
FIG. 15 is a perspective view of a straightening roller bearing according to the present invention.
Figure 16:
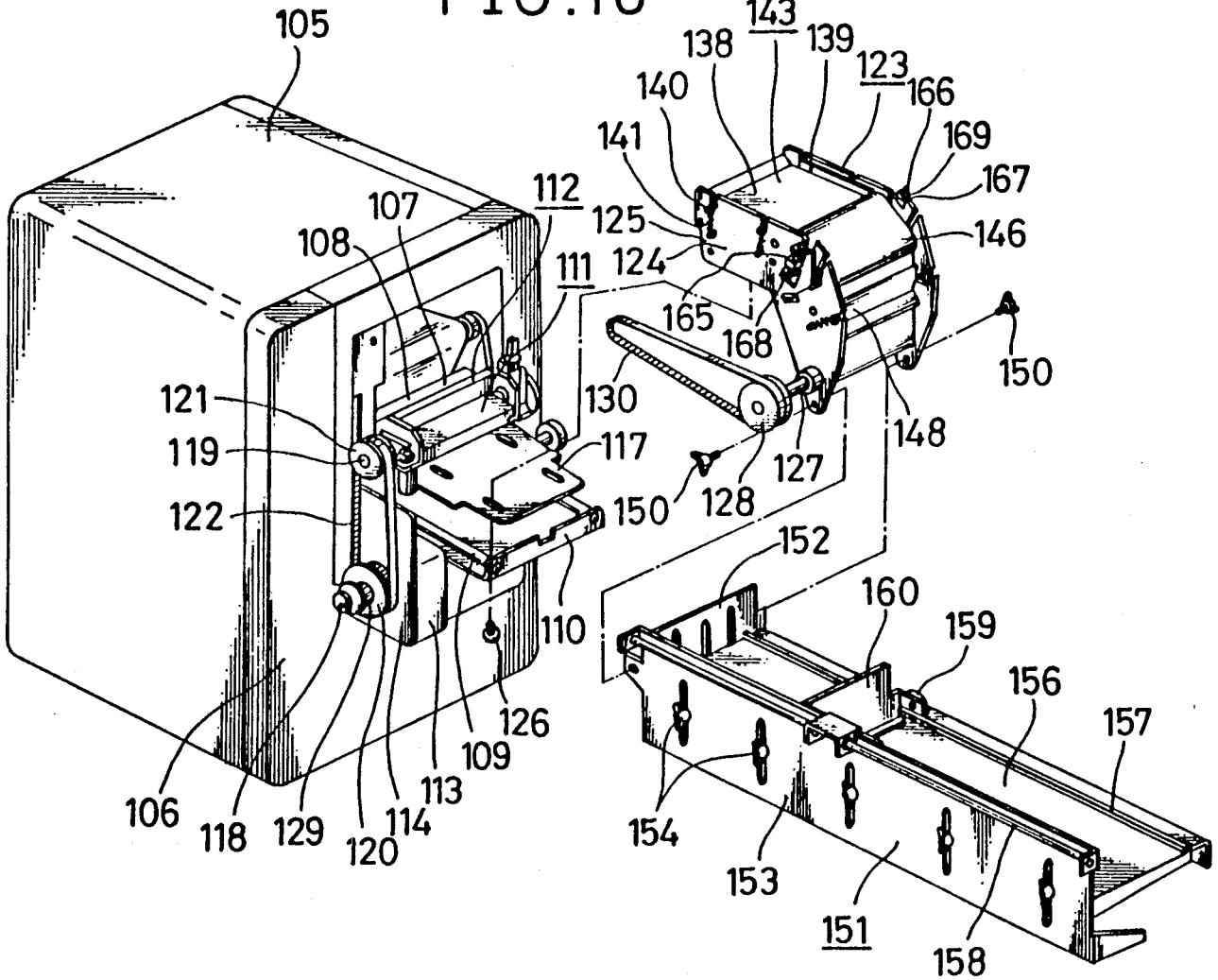
FIG. 16 is an exploded perspective view of the whole assembly of the fourth embodiment.
Figure 17:
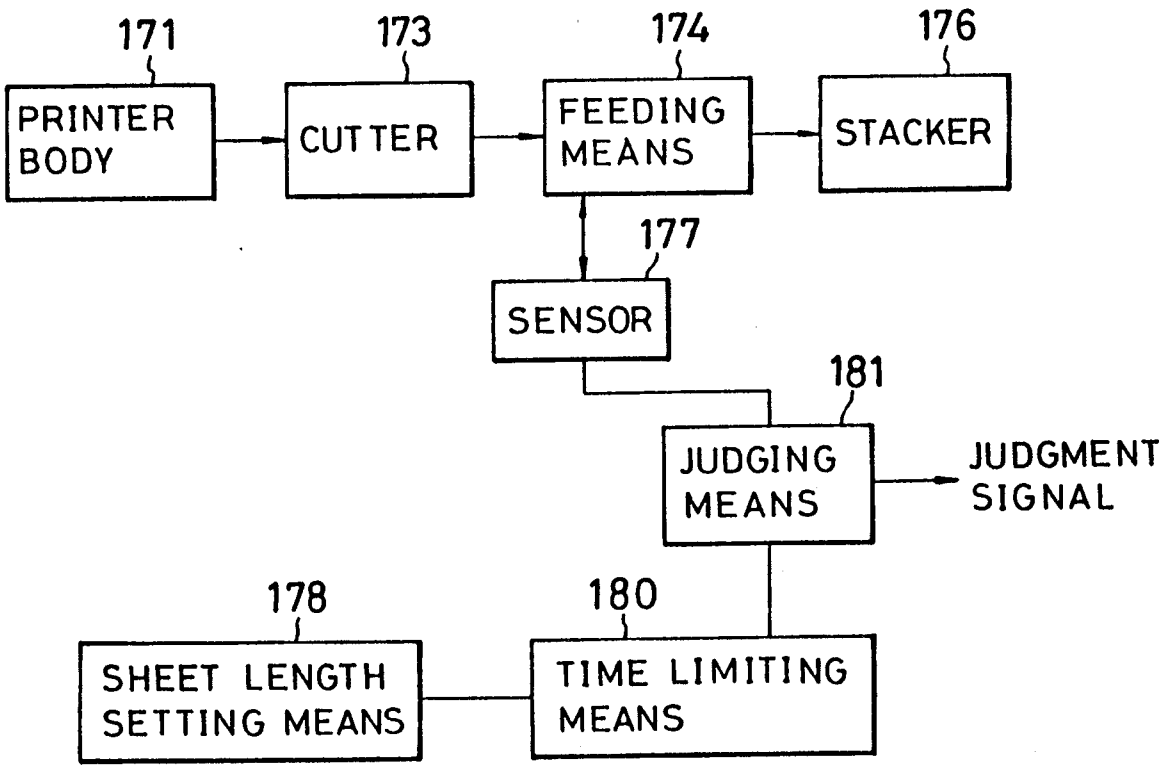
FIG. 17 is a block diagram of a fifth embodiment of the present invention.
Figure 18:
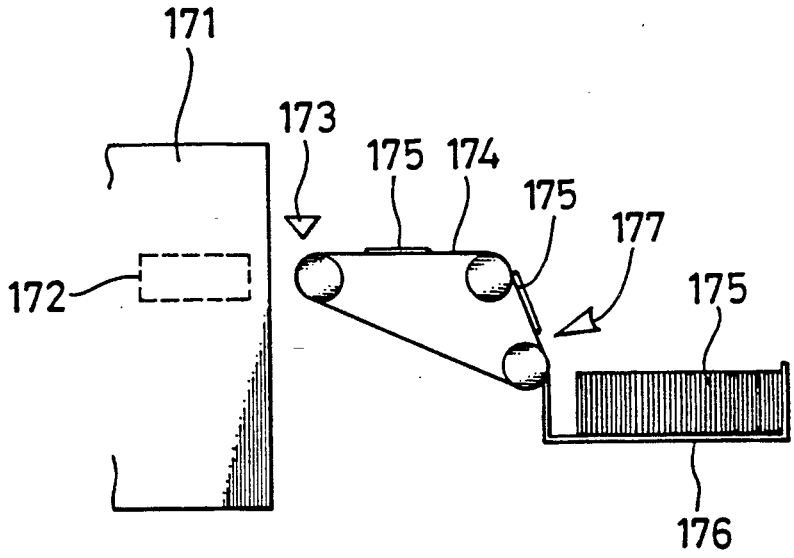
FIG. 18 is a side view outlining the construction of the fifth embodiment.

As illustratively shown in FIG. 11, there is provided a cutting device 97 preceded by a printing mechanism, not shown, along the feeding path of the continuous forms inside the printer 95. In the rear of the cutting device 97 is a feeding belt 99 which bends downward and which leads to a sheet feeding and discharging section 98. The feeding belt 99 has such sheet pushing members as a pressure plate 100, a pressure belt 101 and another pressure plate 102 positioned opposingly in that order downstream of the inlet of sheets 79. The arrangement is designed to get cut sheets 79 pushed diagonally downward from the sheet feeding and discharging section 98. Below the sheet feeding and discharging section 98 are connecting members 104 which project therefrom and which are connected to the other connecting members 96 mentioned above. The printer 95 is removably connected to the sheet stacker 80.

With the printer 95 connected to the sheet stacker 80, the guide rods 89 are at substantially the same height as the end of the feeding belt 99.

Figure 10A:
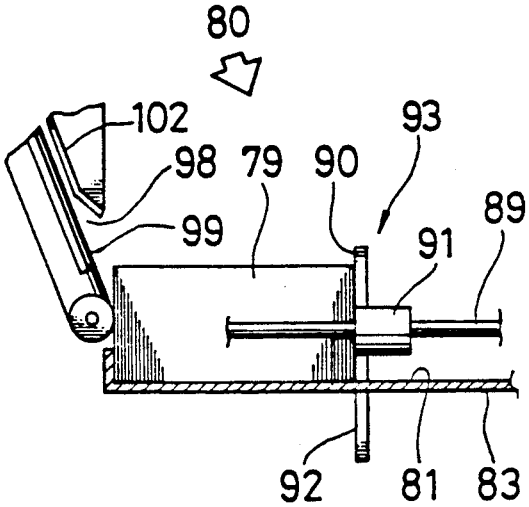
Figure 10B:
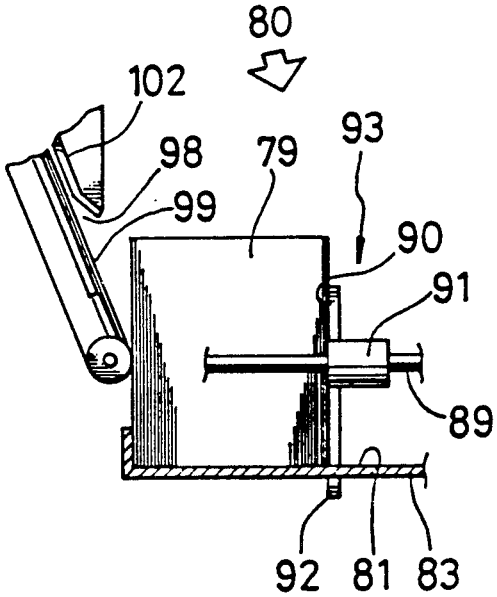

In the above-described construction, sheet 79 after sheet forwarded from the sheet feeding and discharging section 98 of the printer 95 is pushed by the feeding belt 99 into a clearance between the connecting plate 87 and the sheet support surface 90 of the sheet support member 93. As depicted in FIG. 10, the sheets 97 are stacked consecutively onto the stacking member 83, pushing back the sheet support member 93 as they arrive. At this time, the plate springs and their related parts in the supports 91, being in contact with the guide rods 89, exert a degree of frictional resistance to the sheet support member 93. As it slides along, the sheet support member 93 thus applies a suitable pressure to the sheets 79 so that they remain upright.

Furthermore, as described above, the sheet stacker 80 has the guide rods 89 positioned at substantially the same height as the end of the feeding belt 99. This allows, as shown in FIG. 10, the pressure of the sheets 79 pushed in by the feeding belt 99 to be applied to the supports 91 of the sheet support member 93. Therefore, the sheet support member 93 slides quite smoothly without developing a level of moment high enough to cause the sheets to fall. Because the height of the stacking member 83 is adjustable, varying sizes of the sheet 79 are accommodated thereby. This allows the sheets of diverse sizes to remain upright when stacked. On the sheet stacker 80, the projection 92 from the sheet support member 93 is movably inserted in the sliding grooves 82 along the stacking member 83. When the stacking member 83 is relocated downward, this arrangement keeps the sheet support member 93 from getting detached from the sheet receiving surface 81, thereby preventing the sheets 79 from falling or crumpling.

A fourth embodiment of the present invention will now be described by referring to FIGS. 12 through 16. A printer case 105 for the printer is of a cubic prism shape. Inside the printer case 105, there is provided a printing mechanism for printing onto a roll of continuous forms located in a printing forms housing section, not shown. One side 106 of the printer case 105 comprises a continuous forms discharging port 108 with a label guide 107 projecting therefrom.

The side 106 of the printer case 105 comprises a fixture 110 which projects therefrom and which has two parallel rod-shaped rails 109. Along the rails 109 of the fixture 110, there is mounted a cutter device 112 containing a cutter 111. Freely relocatable on the rails 109, the cutter device 112 may be fixed wherever desired. That is, an operation knob A is attached to the fixture 110. A pinion, not shown, is fixed to the shaft on which the operation knob A is mounted. Engaged with the pinion is a rack, not shown, contained in the cutter device 112. Turning the operation knob A moves the cutter device 112 along the rails 109 of the fixture 110. The cutter device 112 has a frame 114 equipped with a motor 113. The frame comprises a rotary blade 115 and a fixed blade 116 constituting the cutter 111, and a sheet feeding apparatus support member 117 which is above the fixture 110 and in parallel therewith.

Pulleys 120 and 121 are fixed respectively to a motor shaft 118 of the motor 113 and to a shaft 119 of the rotary blade 115. A timing belt 122 is wound around the pulleys 120 and 121. Between the shaft 119 of the rotary blade 115 and the pulley 121, there is provided a clutch that is engaged and disengaged by a solenoid, not shown. This prevents the rotary blade 115 from turning during continuous operation of the motor 113 unless and until the clutch is engaged.

A sheet feeding apparatus 123 is attached to the sheet feeding apparatus support member 117 constituting the sheet feeding path B. The sheet feeding apparatus 123 has a base 125 which in turn has side plates 124 facing each other. The base 125 is attached by four setscrews 126 to the sheet feeding apparatus support member 117. An idle shaft 127 is located at the lower end of the base 125. A pulley 128 is fixed to the idle shaft 127, and the pulley 120 is integrally incorporated in a belt winding section 129. A timing belt 130 connects, and is wound around, the pulley 128 and the belt winding section 129. Close to the cutter 111 of the base 125, there is mounted a driven shaft 131. Two intermediate shafts 132 and 133 are installed between the driven shaft 131 and the idle shaft 127. An endless belt 134 of a constant width is wound around the idle shaft 127, driven shaft 131, and intermediate shafts 132 and 133. The belt 134 moves at a rate higher than the feed rate of the continuous forms in the printer case 105. Inside the belt 134 and between the driven shaft 131 and the intermediate shaft 132, there is provided a flat-shaped, horizontally positioned belt guide plate 135. Inside the belt 134 and between the intermediate shaft 132 and the idle shaft 127, there is provided a curved belt guide plate 136, one end thereof being smoothly bent downward.

Above the belt 134 on top of the belt guide plate 135, there is provided a flat-shaped pressure plate 138 having a flat contact surface 137. Two support pins 140 are attached to each of vertical walls 139 on both sides of the pressure plate 138. Springs 141 engaged with the support pins 140 provide downward pressure. That is, these components constitute a sheet traversing section 143 wherein a sheet of paper 142 cut by the cutter 111 is pressed down flat when forwarded.

Two belt rollers 144 and 145 are provided, one immediately above the intermediate shaft 132 and then, a little in back thereof. A pressure belt 146 is wound around the belt rollers 144 and 145. Part of the inner surface of the pressure belt 146 is curved along the curved surface of the curved belt guide plate 136. The curved belt guide 136, the pressure belt 146 and the belt 134 constitute a sheet direction changing section 147 whereby the feed direction of each cut sheet 142 is changed.

The curved belt guide plate 136 comprises a corrective concavity 161 which is long perpendicular to the feed direction of sheets 142 and which is formed concave downward. Above the corrective concavity 161, there is provided a corrective roller 162 pressed against the inner surface of the pressure belt 146. A shaft 163 of the corrective roller 162 projects from the side plates 124 through their openings 164 on the base 125. Corrective roller bearings 165 are mounted on both sides of the shaft 163. Each corrective roller bearing 165 has a support shaft 166 projecting from the top and bottom thereof. On each side plate 124, there are provided bearing support members 167 and 168 bent toward each other. The upper portion of each support shaft 166 is threaded and inserted into the bearing support member 167. The threaded shaft portion is secured in a vertically movable manner by two nuts 169 sandwiching the bearing support member 167. The lower portion of the support shaft 166 is inserted into a notch 170 which opens outward on the bearing support member 168.

A pressure plate 148 is installed against the belt 134 in back of the curved belt guide plate 136. The pressure plate 148, the curved belt guide plate 136 and the belt 134 constitute a sheet pushing section 149. As with the pressure plate 138 described earlier, this pressure plate 148 also has support pins 140 on its sides. On the side plates 124, the springs 141 engaged with the support pins 140 exert pressure onto the belt 134.

The sheet stacker 151 is removably attached by thumbscrews 150 to the lower end of the bate 125 for the sheet feeding apparatus 123. The sheet feeding apparatus 151 comprises a front support plate 152 and a fixed side plate 153 positioned perpendicularly thereto. A base plate 156 is attached by thumbscrews 154 in a vertically movable manner to the support plate 152 and the fixed side plate 153. A guide rail 157 is mounted on the base plate 156. A rod-shaped guide shaft 158 is mounted on the upper end of the fixed side plate 153. A sheet holding plate 160 having a roller 159 that moves outside the guide rail 157 is slidingly engaged with the guide shaft 158. The sheet holding plate 160 is under a constant level of braking pressure from a plate spring, not shown, pressed against the circumference of the guide shaft 158.

In the above-described construction, the printing mechanism inside the printer case 105 prints necessary text on the continuous forms. When the tip of the printed continuous forms comes out of the label guide 107, the motor 113 is activated. The motor 113 turns the rotary blade 115 of the cutter 111 against the fixed blade 116 thereof, cutting the forms into a sheet 142 of a predetermined size. The tip of the cut sheet 142 is already seized by the sheet traversing section with its pressure plate 138. This allows the sheet 142, immediately after being cut, to be forwarded fast by the belt 134 that turns at a rate higher than the feed rate of the continuous forms. For this reason, there develops a constant distance between each cut sheet and the leading edge of the continuous forms yet to be cut. Because the contact surface 137 of the pressure plate 138 is smooth, a contact of the printed surface of the sheet 142 against the contact surface 137 does not smear the printed text with, say, ink blur or transfer.

The sheet 143 cut in this manner is secured between the pressure belt 146 and the belt 134, and is changed in the feed direction a little downward by the sheet direction changing section 147.

Meanwhile, having been cut from the rolled continuous forms, the sheet 142 has a tendency to curl in the feed direction. In this embodiment, the middle of the sheet 142 tends to be convex. In that state, the sheet 142 passes the sheet direction changing section 147. A curl-correcting action is carried out by the corrective roller 162 pressing the belt 134 and the pressure belt 146 against the corrective concavity 161 located in the sheet direction changing section 147. The correction is achieved because the radius of curvature of the concave portion is small enough to compensate the convex curl of the sheet 142 when it is pressed thereonto. The result is a flow of straightened, flat sheets. When straightened out and changed in direction, the sheet 142 is inserted into a space behind the last sheet of a stack of perpendicularly positioned sheets on the sheet stacker 151. Specifically, the sheet 142 having arrived last is positioned perpendicularly by the idle shaft 127, while the sheet-feeding belt 134 is installed diagonally. Thus there develops a V-shaped space above the sheet last placed on the sheet stacker 151. This allows each successive sheet to be inserted reliably. A sufficient level of pushing force onto the sheet 142 is obtained here from the frictional force derived from the contact between the pressure plate 148 and the belt 134 supported by the curved belt guide plate 136. When the lower edge of the sheet 142 touches the base plate 156 of the sheet stacker 151, the sheet stops and becomes another sheet added to the stack thereon.

A fifth embodiment of the present invention will now be described by referring to FIGS. 17 through 21. A printer body 171 contains a printing mechanism 172 for printing onto long, continuous forms. Close to a sheet outlet on the printer body 171, there is provided a cutter 173 followed downstream by a sheet feeding path 174. The feed rate of the sheet feeding path 174 is set higher than that of the printing mechanism 172. At the end of the sheet feeding path 174, there is provided a sheet stacker 176 that accommodates a stack of perpendicularly placed sheets 175 cut in the form of labels or tags. Close to the sheet stacker 176, there is provided a sensor 177 that detects the presence of the sheet 175.

A control section, not shown, of the printer body 171 has a sheet length setting means 178 for setting the length of the sheet 175 to be cut. Connected to the sheet length setting means 178 is a period setting means 179 for setting sheet feeding periods based on the sheet length established. A feeding period is determined after the feed rate of the sheet feeding path 174 is taken into account. In practice, two periods are to be set: period $P_1$ corresponding to the length of the sheet 175, and period $P_2$ corresponding to the interval between sheets 175.

It is assumed that it takes the sensor 177 time $T_1$ to detect a sheet, and time $T_2$ to detect a sheet-to-sheet interval. The time and period settings are established as:

$$R_1 > T_1,\ P_2 > T_2$$

The period settings are stored in a memory contained in a time limiting means 180. The time limiting means 180 outputs periods $P_1$ and $P_2$ as required.

The time limiting means 180 and the sensor 177 are connected to a judging means 181. The judging means 181 compares the output of the time limiting means 180 with that of the sensor 177, to judge if the sheet 175 is fed normally or being jammed.

In the above-described construction, a length X of the sheet 175 is set before the printing in label or tag format begins. Specifically, the sheet length setting means 178 inputs the necessary length of the sheet 175. The length X is input into a memory, not shown. At the same time, the period setting means 178 calculates period $P_1$ corresponding to the length X and period $P_2$ corresponding to the sheet-to-sheet interval. The periods $P_1$ and $P_2$ are acquired on the assumption that the feed rate of the sheet feeding path 174 remains constant.

Then a desired number of sheets 175 is input from a keyboard, not shown, on the printer body 171.

With these preparations completed, the printing mechanism 172 starts its printing operation. The cutter 173 cuts the printed continuous forms to length X. Following the cutting, there is a delay that corresponds to the feed time taken between the cutter 173 and the sensor 177 along the sheet feeding path 174, before a timer for setting period $P_1$ starts. That is, the time limiting means 180 is activated at this point. Immediately thereafter, the input from the sensor 177 is accepted so that a change in the output level thereof is detected.

Figure 19:
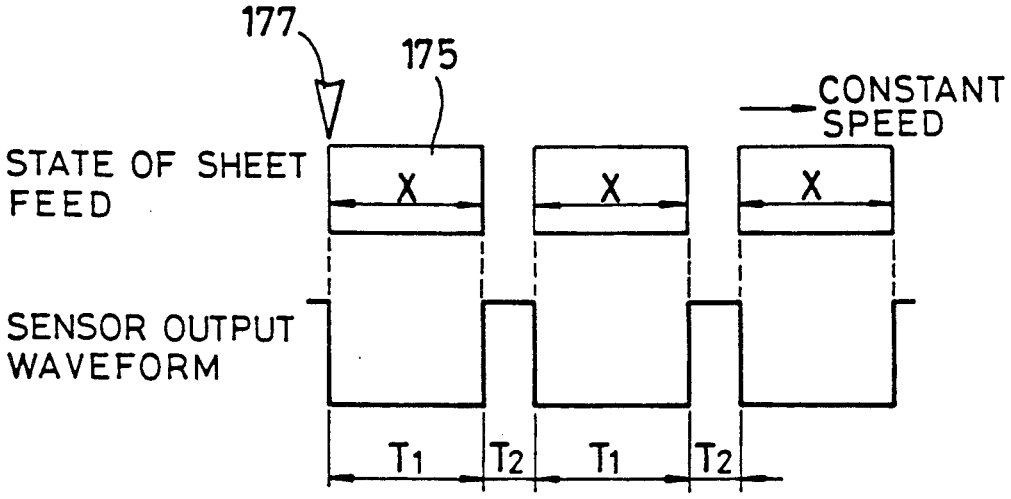
FIG. 19 is a view which describes how the state of sheet feed is reflected in the output waveform of the sensor.
Figure 20:
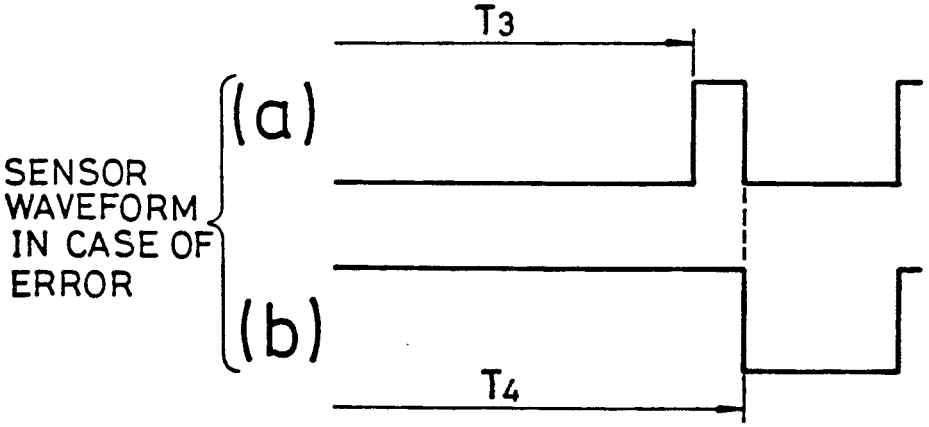
FIG. 20 is a waveform chart illustrating the waveform from the sensor in case of error.
Figure 21:
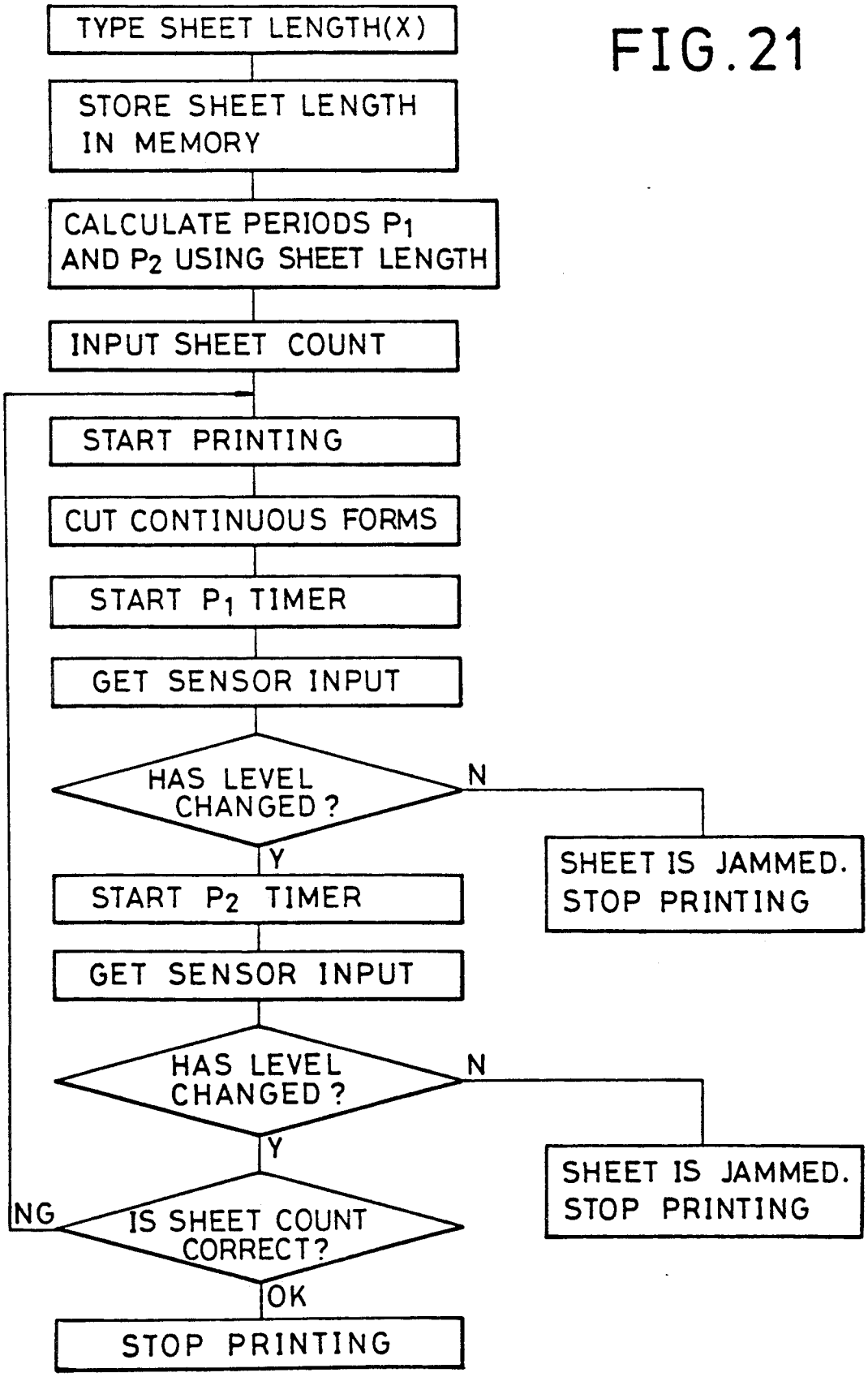
FIG. 21 is a flowchart which outlines how the embodiments of the invention work.

FIG. 19 shows that the feed time corresponding to the length of the sheet 175 is $T_1$, that the period set by the time limiting means 180 is $P_1$, and that $P_1 > T_1$. Thus the output of the sensor 177 always changes during period $P_1$ if the sheet 175 is normally fed. If the change is detected by the judging means 181, that means the sheet 175 is normally fed. If no change appears in the output the sensor 177 during period $P_1$, i.e., if no change in the output occurs during time $T_1$ or $T_2$ as shown in FIG. 20 (*a*) and (*b*) , that means the sheet is being jammed. The judging means 181 then outputs a jam signal, bringing the printer body 171 to a stop.

When nothing unusual occurs in terms of the timing for detecting the sheet 175, a change in the output of the sensor 177 simultaneously causes the time limiting means 180 to start its $P_2$ timer. Then the input of the sensor 177 is accepted so as to see if any change has taken place in the output during period $P_2$. If no change is detected during period $P_2$, that means the sheet is jammed; if a change is detected, that means the sheet is fed normally.

The above process is repeated as many time as required until the established number of sheet has been printed. The printed and cut sheets 175 are stacked on the sheet stacker 6. When the sheet count is exhausted, the printing operation stops.

What is claimed is:

1. A printer with a sheet feeding apparatus comprising a printer case incorporating a printing mechanism for printing onto continuous forms, said printer case having a continuous forms discharging port adjacent to which is provided a cutter for cutting sheets off said continuous forms, a sheet stacker for stacking said cut sheets in a substantially horizontal direction, said stacker positioning each sheet in a substantially perpendicular manner, said sheet stacker being locationally preceded upstream by a sheet feeding path which originates at said cutter, said sheet feeding path being equipped with a corrective roller, said corrective roller having mounting means by which it is pressed against said sheets so as to correct curling tendencies thereof following the cutting of said continuous forms.

2. A printer with a sheet feeding apparatus according to claim 1, wherein said mounting means presses said corrective roller against said sheets in a manner in which the amount of pressure being applied thereto is varied as desired so as to remove curling tendencies from said sheets.

3. A printer with a sheet feeding apparatus according to claim 1 wherein said mounting means includes bearings for said corrective roller, each bearing having a support shaft projecting from the top and bottom of said bearing, said mounting means further including side plates with the upper portion of said support shafts being threaded so as to be mounted on said side plates in a vertically movable manner.

* * * * *